US009722317B2

(12) United States Patent
Lee et al.

(10) Patent No.: US 9,722,317 B2
(45) Date of Patent: Aug. 1, 2017

(54) 2-PORT ANTENNA HAVING OPTIMUM IMPEDANCES OF A TRANSMITTER AND A RECEIVER

(71) Applicants: SAMSUNG ELECTRONICS CO., LTD., Suwon-si (KR); SNU R&DB FOUNDATION, Seoul (KR)

(72) Inventors: Jae Sup Lee, Yongin-si (KR); Seong Joong Kim, Suwon-si (KR); Seok Ju Yun, Hwaseong-si (KR); Sang Wook Nam, Seoul (KR); Su Min Yun, Incheon (KR)

(73) Assignees: Samsung Electronics Co., Ltd., Suwon-si (KR); SNU R&DB Foundation, Seoul (KR)

( * ) Notice: Subject to any disclaimer, the term of this patent is extended or adjusted under 35 U.S.C. 154(b) by 489 days.

(21) Appl. No.: 14/186,553

(22) Filed: Feb. 21, 2014

(65) Prior Publication Data

US 2014/0240191 A1 Aug. 28, 2014

(30) Foreign Application Priority Data

Feb. 22, 2013 (KR) ..... 10-2013-0019399

(51) Int. Cl.
*H01Q 1/50* (2006.01)
*H01Q 13/18* (2006.01)

(52) U.S. Cl.
CPC ..... *H01Q 13/18* (2013.01)

(58) Field of Classification Search
CPC ..... H01Q 1/50; H01Q 13/18
USPC ..... 343/700 MS, 767, 745, 746, 852
See application file for complete search history.

(56) References Cited

U.S. PATENT DOCUMENTS 4,916,457 A * 4/1990 Foy ..... H01Q 21/064 343/768
6,018,320 A * 1/2000 Jidhage ..... H01Q 1/36 343/700 MS
7,271,776 B2 * 9/2007 Le Bolzer ..... H01Q 21/20 343/767

(Continued)

FOREIGN PATENT DOCUMENTS

JP 2006-41563 A 2/2006
JP 2011-142634 A 7/2011

(Continued)

OTHER PUBLICATIONS

Rajagopalan, Harish, et al.. "Platform Tolerant and Capsule-Pill RFID Antenna Designs: An Overview of Recent Developments at UCLA." Antenna Technology (iWAT), 2012 IEEE International Workshop on. IEEE, 2012. (4 pages, in English).

*Primary Examiner* — Graham Smith
*Assistant Examiner* — Jae Kim
(74) *Attorney, Agent, or Firm* — NSIP Law

(57) ABSTRACT

An antenna is described including a slot formed in a cavity, a substrate configured to cover a portion of the cavity and the slot, and a first port and a second port configured to supply power to the antenna using a first feeding line and a second feeding line. Each of the feeding line and the second feeding line is connected to the slot in a vertical direction and disposed to be separate from one another. A first input impedance of the antenna from the first port differs from a second input impedance of the antenna from the second port.

11 Claims, 7 Drawing Sheets

(56) References Cited

U.S. PATENT DOCUMENTS

| | | | | |
|---|---|---|---|---|
| 8,120,536 | B2 * | 2/2012 | Lindmark | H01Q 9/0435 343/700 MS |
| 2003/0122721 | A1 * | 7/2003 | Sievenpiper | H01Q 9/14 343/767 |
| 2004/0041732 | A1 * | 3/2004 | Aikawa | H01Q 9/0457 343/700 MS |
| 2007/0080881 | A1 * | 4/2007 | Thudor | H01Q 13/106 343/767 |
| 2008/0001828 | A1 | 1/2008 | Black et al. | |
| 2010/0277319 | A1 * | 11/2010 | Goidas | H01Q 1/2216 340/572.1 |
| 2012/0319918 | A1 | 12/2012 | Ramachandran et al. | |
| 2013/0141296 | A1 * | 6/2013 | Jaffri | H01Q 13/18 343/770 |

FOREIGN PATENT DOCUMENTS

| | | | |
|---|---|---|---|
| KR | 2003-0062134 | A | 7/2003 |
| KR | 10-2005-0120518 | A | 12/2005 |
| KR | 10-2008-0025105 | A | 3/2008 |
| KR | 10-2012-0012152 | A | 2/2012 |
| KR | 10-2012-0057153 | A | 6/2012 |
| WO | WO 01/09978 | A1 | 2/2001 |

* cited by examiner

2-PORT ANTENNA HAVING OPTIMUM IMPEDANCES OF A TRANSMITTER AND A RECEIVER

CROSS-REFERENCE TO RELATED APPLICATION(S)

This application claims the benefit under 35 U.S.C. §119 (a) of Korean Patent Application No. 10-2013-0019399 filed on Feb. 22, 2013, in the Korean Intellectual Property Office, the entire disclosure of which is incorporated herein by reference for all purposes.

BACKGROUND

1. Field

The following description relates to a two-port antenna having optimum impedances for a transmitter and a receiver.

2. Description of Related Art

In a human body communication system, transmission power may be relatively low due to electromagnetic wave safety regulations for a human body or a limitation on a battery. As a result, each of a transmitter and a receiver may have a relatively high magnitude in optimum impedance. Thus, the human body communication system may require a matching circuit having a high impedance conversion ratio. However, due to a limited quality (Q) factor of an element for use in the matching circuit and the high impedance conversion ratio, efficiency of an entire system may be low and narrowband may occur.

SUMMARY

In one general aspect, there is provided an antenna including a slot formed in a cavity; a substrate configured to cover a portion of the cavity and the slot; and a first port and a second port configured to supply power to the antenna using a first feeding line and a second feeding line. A first input impedance of the antenna from the first port differs from a second input impedance of the antenna from the second port.

The first input impedance may vary based on a feeding offset from a center of the slot to a first feeding point, at which the slot is in contact with the first feeding line.

The second input impedance may vary based on a feeding offset from a center of the slot to a second feeding point, at which the slot is in contact with the second feeding line.

The antenna may also include a first switch disposed in the first feeding line to switch, to the slot, power supplied through the first feeding line. A resonant frequency of the antenna may be adjusted based on a position of the first switch in the first feeding line.

The antenna may further include a second switch disposed in the second feeding line to switch, to the slot, power supplied through the second feeding line. A resonant frequency of the antenna may be adjusted based on a position of the second switch in the second feeding line.

In another general aspect, there is provided an antenna including a first port and a second port configured to supply power using a first feeding line and a second feeding line formed in a ground, wherein a portion of the second feeding line is disposed parallel to the first feeding line and a remaining portion of the second feeding line is disposed vertically relative to the first feeding line; and a patch portion, separate from the ground, configured to cover a portion of the ground, and comprising a radiation portion. The radiation portion is recessed at a depth along a boundary of the patch portion, and is configured to radiate energy generated using the supplied power. A first input impedance of the antenna from the first port differs from a second input impedance of the antenna from the second port.

A dielectric layer may be disposed between the ground portion and the patch portion.

The first input impedance may be adjusted based on a position of an end portion of the first feeding line.

The second input impedance may be adjusted based on a position of an end portion of the second feeding line.

A resonant frequency of the antenna may be adjusted based on a depth to which the first feeding line or the second feeding line penetrates into the ground.

The first port may be separate from the second port, and the first port and the second port, each is connected to the slot in a vertical direction.

In another general aspect, there is provided an antenna including a first feeding line connected to one end of a slot and connected to a first port at another end; a second feeding line connected to an opposite end of the slot and connected to a second port at another end; a first switch disposed in the first feeding line; and a second switch disposed in the second feeding line. A first input impedance at the first port and a second input impedance at the second port are attuned by adjusting a feeding position of the first switch and the second switch.

A resonant frequency of the antenna may be adjusted based on a position of the first switch in the first feeding line.

A resonant frequency of the antenna may be adjusted based on a position of the second switch in the second feeding line.

When a distance between the slot and the first switch in the first feeding line increases, the resonant frequency of the antenna in the second port may decrease.

When a distance between the slot and the second switch in the second feeding line 140 increases, the resonant frequency of the antenna in the first port may decrease.

The feeding offset may be distance from a center point of the slot to each of a feeding point and a feeding point, at which the slot is in contact with each of the feeding line and the feeding line, may be referred to as the feeding offset.

The first input impedance may vary by adjusting the feeding position from a center of the slot to a first feeding point, at which the slot is in contact with the first feeding line.

The second input impedance may vary by adjusting the feeding position from a center of the slot to a second feeding point, at which the slot is in contact with the second feeding line.

Each of the first port and the second port may be connected to the slot in a vertical direction.

DETAILED DESCRIPTION

Embodiments now will be described more fully hereinafter with reference to the accompanying drawings. The embodiments may, however, be embodied in many different forms and should not be construed as limited to the embodiments set forth herein. Like numbers refer to like elements throughout.

Figure 1:
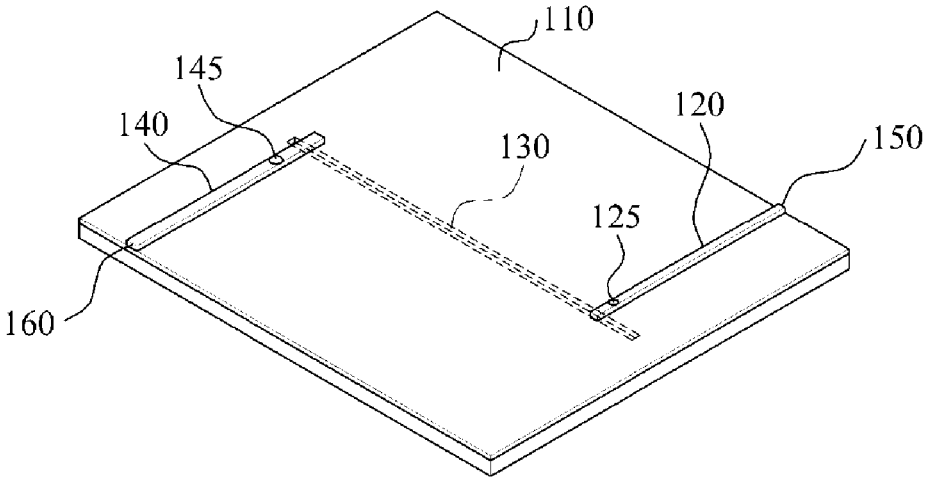
FIG. 1 illustrates an example of a configuration of an antenna.
Figure 1:
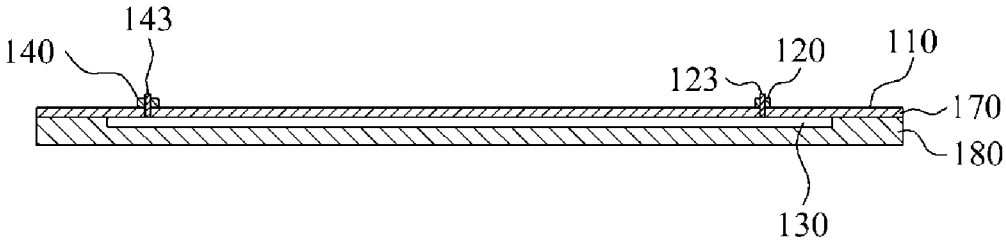

FIG. 1 illustrates an example of a configuration of an antenna.

Referring to FIG. 1, a configuration of a two-port cavity-backed slot antenna is shown.

A metallic conductor, for example, a cavity 180 is disposed at a lowest portion of the antenna, and a slot 130 may be formed across a center portion of the cavity 180.

The slot 130 may be formed to be recessed in the cavity 180 to radiate, to an external area, energy generated using power supplied through a first feeding line 120 and a second feeding line 140. The slot 130 may be referred to as a radiation portion.

A substrate 170 may be used for a feeding. The substrate 170 covers at least a portion of the cavity 180 and the slot 130 formed in the cavity 180. An upper plane of the substrate 170 may be covered with a dielectric substance 110. For example, the substrate 170 may be a printed circuit board (PCB) or a dielectric substrate.

When the dielectric substrate is used, an additional dielectric substance is optional and may not be required.

A first port 150, a second port 160, the first feeding line 120, and the second feeding line 140 to be used, individually or combined, in a feeding may be formed on the substrate 170 covered with the dielectric substance 110.

The first feeding line 120 and the second feeding line 140 are configured, for example, using a microstrip line made of a copper material.

In this example, a first switch 125 is disposed in the first feeding line 120 to switch, to the slot 130, power supplied through the first feeding line 120. The first feeding line 120 is connected to the slot 130 through a via 123, and the second feeding line 140 may be connected to the slot 130 through a via 143.

A second switch 145 is disposed in the second feeding line 140 to switch, to the slot 130, power supplied through the second feeding line 140.

In this example, a resonant frequency of the antenna is adjusted based on a position of the first switch 125 in the first feeding line 120. In the alternative, the resonant frequency of the antenna is adjusted based on a position of the second switch 145 in the second feeding line 140.

Figure 5:
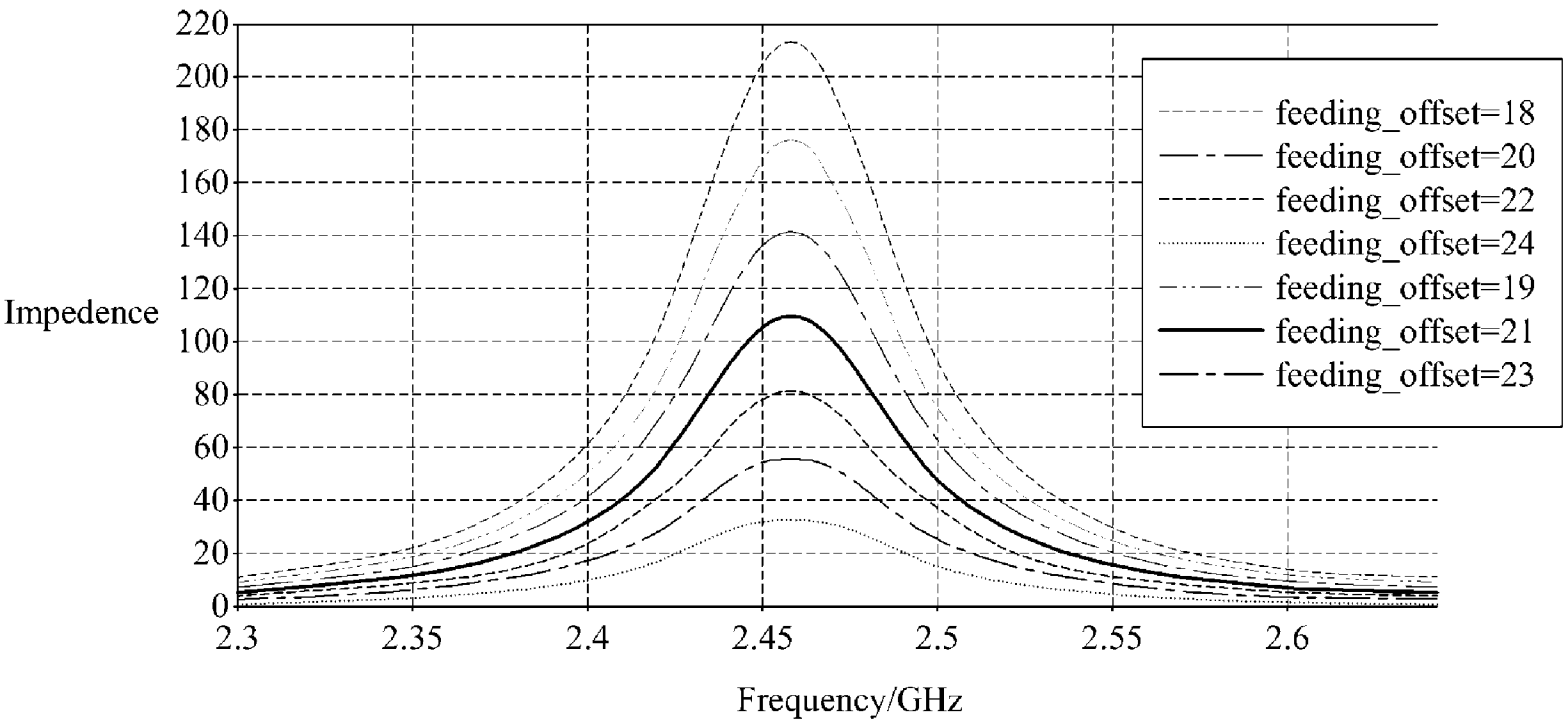
FIG. 5 illustrates an example of a change in input impedance based on a different feeding position in a two-port cavity-backed slot antenna.

FIG. 5 illustrates an example of a distribution of an electric field (E-field in a z-direction relative to an internal area of a cavity in a two-port cavity-backed slot antenna. In one example, when a distance between the slot 130 and the first switch 125 in the first feeding line 120 of FIG. 1 increases, the resonant frequency of the antenna at the second port 160 may decrease and all lines of a graph of FIG. 5 may shift in a left direction. Also, when a distance between the slot 130 and the second switch 145 in the second feeding line 140 increases, the resonant frequency of the antenna at the first port 150 may decrease, and all lines of the graph of FIG. 5 may shift in a left direction.

In contrast, the smaller a distance between the slot 130 and the first switch 125 in the first feeding line 120, the greater the resonant frequency of the antenna at the second port 160.

The first feeding line 120 and the second feeding line 140 may be connected to the slot 130 in a vertical direction, and disposed separate from one another. One end of the first feeding line 120 may be connected to the slot 130, and another end of the first feeding line 120 may be connected to the first port 150.

The first port 150 may supply power to the antenna through the first feeding line 120.

One end of the second feeding line 140 may be connected to the slot 130, and another end of the second feeding line 140 may be connected to the second port 160.

The second port 160 may supply power to the antenna through the second feeding line 140.

In this example, a first input impedance at the first port 150 and a second input impedance at the second port 160 may be changed or attuned by adjusting a feeding position of the antenna. Descriptions about a method of attuning an input impedance will be provided with reference to FIG. 2.

Figure 2:
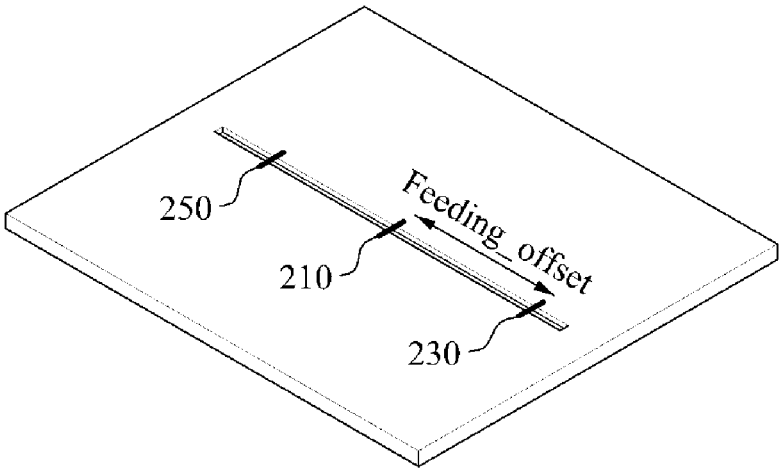
FIG. 2 illustrates an example of a feeding offset of the antenna of FIG. 1.

FIG. 2 illustrates an example of a feeding offset of the antenna of FIG. 1.

As described above, a center portion of the antenna may include the slot 130. A distance from a center point 210 of the slot 130 to each of a feeding point 230 and a feeding point 250, at which the slot 130 is in contact with each of the feeding line 120 and the feeding line 140, may be referred to as the feeding offset.

The antenna may be a two-port antenna. Therefore, a number of the feeding point 230 and the feeding point 250 at which the slot 130 is in contact with the feeding line 120 and the feeding line 140 may be two. First input impedance of the antenna viewed from the first port 150 may be changed or adjusted based on a feeding offset from the first feeding point 230, at which the slot 130 is in contact with the first feeding line 120. The first input impedance of the antenna viewed from the second port 160 may be changed or adjusted based on a feeding offset from the second feeding point 250, at which the slot 130 is in contact with the second feeding line 140.

The adjusting of the position of the first feeding point 230 and the position of the second feeding point 250 may be performed independently.

In an example, the input impedance of the antenna is attuned by adjusting the feeding position of the antenna. By adjusting the input impedance of the antenna, a position at which each of a transmitter and a receiver acquires optimum impedance may be verified.

Accordingly, feeding lines may be formed by verifying the feeding position at which each of the transmitter and the receiver acquires the optimum impedance. The optimum impedance of each of the transmitter and the receiver may be matched to the input impedance of the antenna by generating a port in the verified feeding position, despite an absence of the impedance matching circuit. Thus, a matching loss caused by a matching circuit is avoided.

To perform the impedance matching, in general, impedances from an access point to each of both ends may be equalized such that all power provided from a signal source may be transferred as a load. However, in an example, the first input impedance of the antenna viewed from the first port 150 may differ from the second input impedance of the antenna viewed from the second port 160 at a formation of a port and a feeding line in the feeding position at which each of the transmitter and the receiver acquires the optimum impedance.

The first input impedance of the antenna viewed from the first port 150 may be, for example, 100 ohms (Ω), and the second impedance of the antenna viewed from the second port 160 may be, for example, 50Ω.

Figure 3:
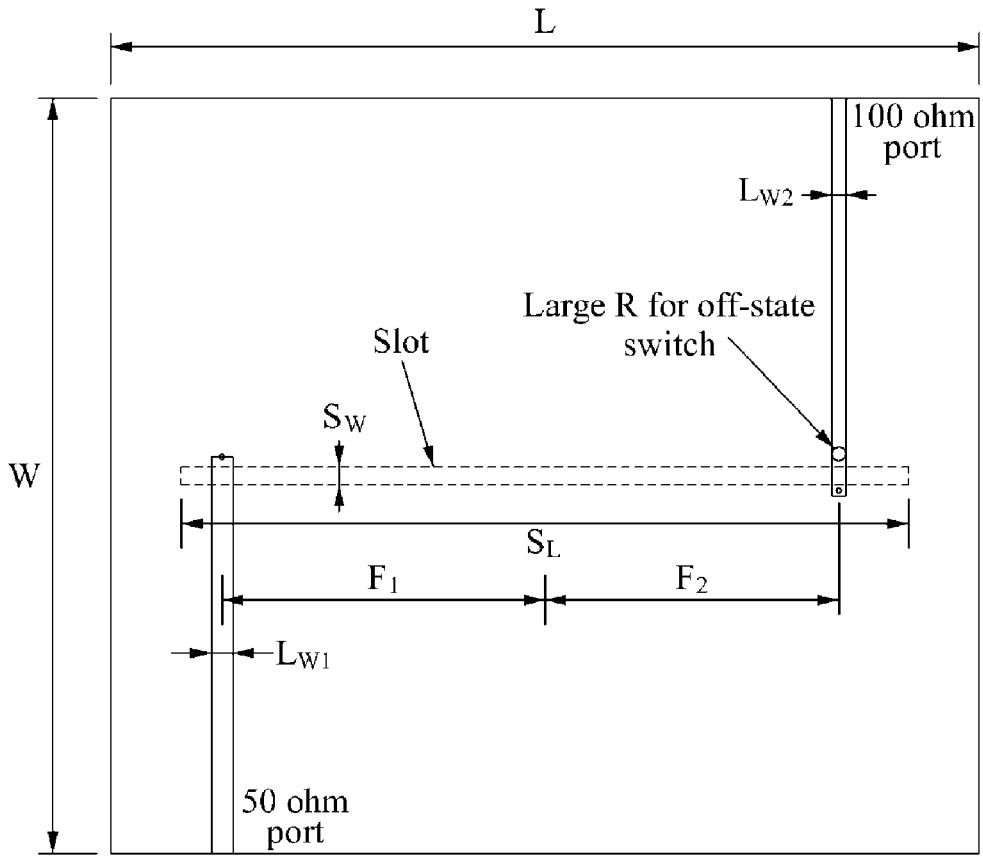
FIG. 3 illustrates an example of an actual configuration of a two-port cavity-backed slot antenna.

FIG. 3 illustrates an example of an actual configuration of a two-port cavity-backed slot antenna.

Referring to FIG. 3, in one configuration, in the two-port cavity-backed slot antenna, a length L of a substrate may be 62 millimeters (mm), a width W of the substrate may be 54 mm, and a length $S_L$ of a slot may be 52 mm. A width $S_W$ of the slot may be 1 mm, a feeding offset $F_1$ may be 23 mm, a feeding offset $F_2$ may be 21 mm, and a width $L_{W1}$ of a feeding line may be 1.48 mm, and a width $L_{W2}$ of a feeding line may be 0.4 mm. Also, an operational frequency or a resonant frequency may be 2.45 gigahertz (GHz).

Also, an RT/Duroid® 5880 Laminates having a length of 1.57 mm may be used as a cavity substrate.

Figure 4:
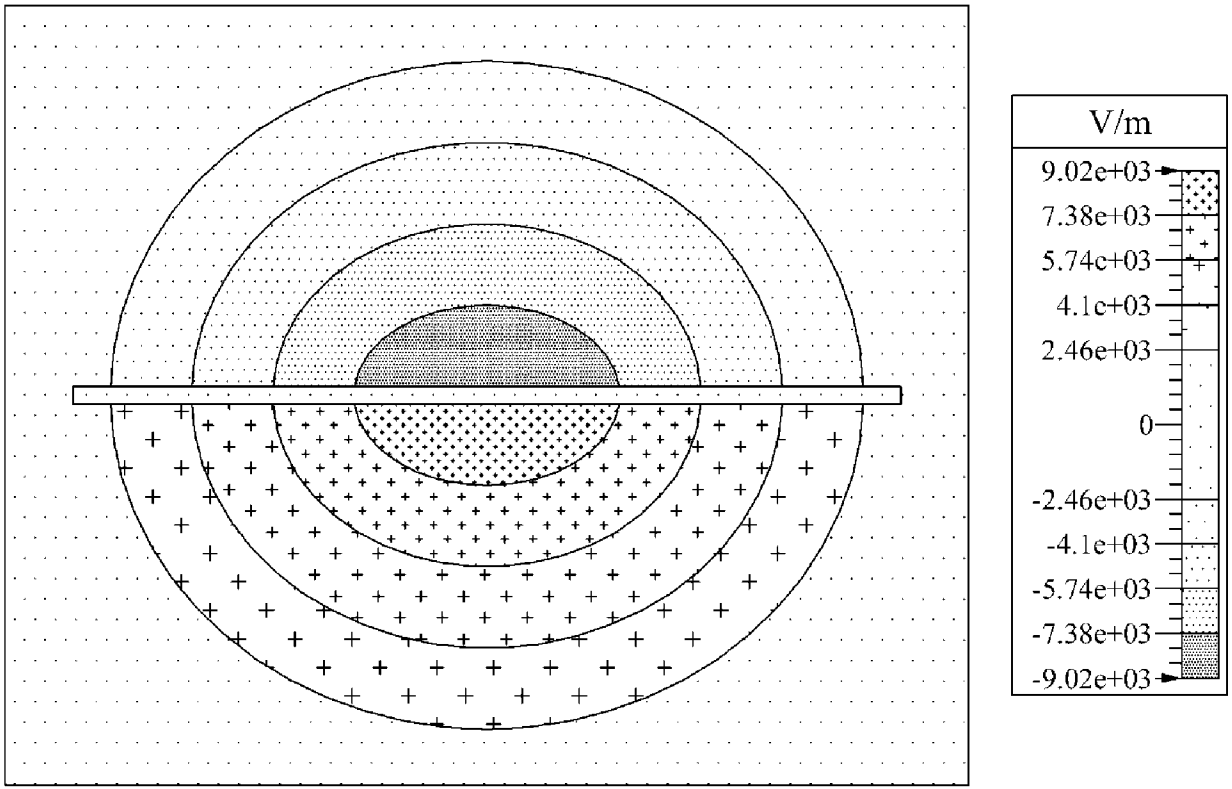
FIG. 4 illustrates an example of a distribution of an electric field (E-field) in a z-direction relative to an internal area of a cavity in the two-port cavity-backed slot antenna.

FIG. 4 illustrates an example of a distribution of an electric field (E-field) in a z-direction relative to an internal area of a cavity in the two-port cavity-backed slot antenna.

Referring to FIG. 4, the E-field distributed in the z-direction in the antenna may be shown. In this example, a maximum E-field may be observed at a center of a cavity, and the E-field may be reduced according to an increase in a distance from the center of the cavity of the two-port cavity-backed slot antenna to each of both ends of the cavity. Because an impedance of the antenna viewed from each port is proportional to an intensity of the E-field, an impedance viewed from a port or a port impedance may have a maximum value at the center of the cavity. Also, the impedance viewed from the port or the port impedance may be reduced according to an increase in a distance from the port to an edge of the cavity.

As described above, in an example, the input impedance of the cavity-backed slot antenna may be changed by relocating a position of the feeding point.

FIG. 5 illustrates an example of a change in input impedance based on a different feeding position in a two-port cavity-backed slot antenna.

Referring to FIG. 5, input impedance of a cavity-backed slot antenna may increase according to an increase in a distance between an antenna port and a center of a cavity is decreased.

In a case of the two-port antenna, each feeding point or a feeding position may be determined based on maximum impedances of a transmitter and a receiver. As described above, when a feeding is performed on the antenna at the feeding point, at which each of the transmitter and the receiver has the maximum impedance, the two-port cavity-backed slot antenna may have the maximum impedance.

Figure 6:
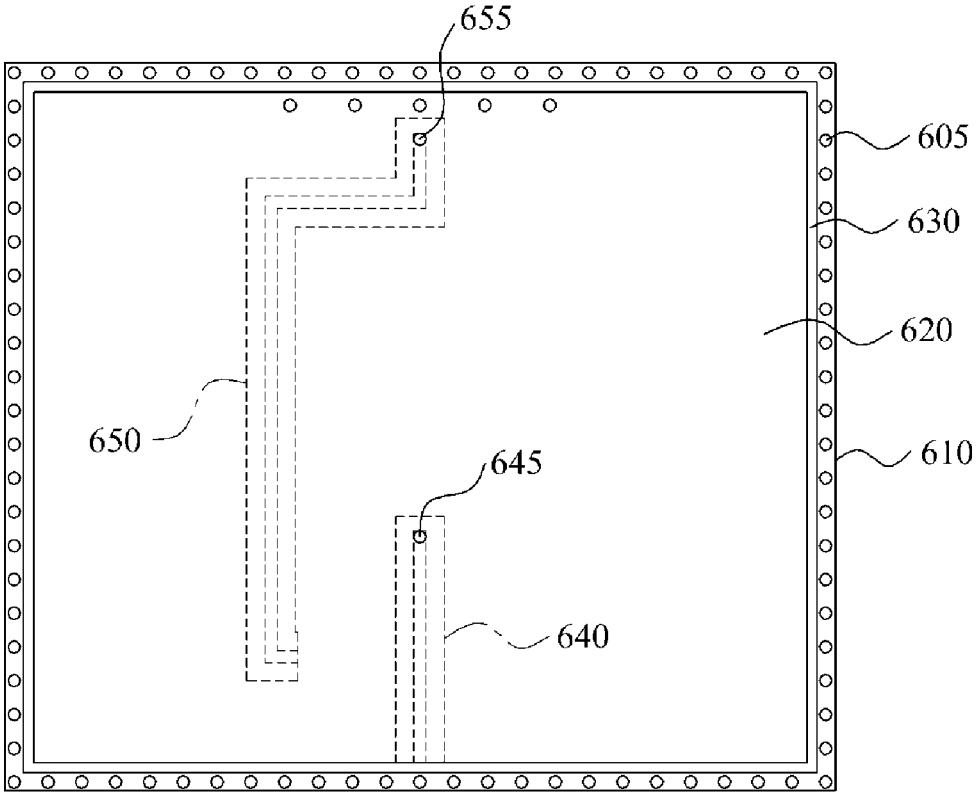
FIG. 6 illustrates another example of a configuration of an antenna.

FIG. 6 illustrates another example of a configuration of an antenna.

Referring to FIG. 6, a configuration of a two-port patch antenna may be shown.

The two-port patch antenna includes a ground portion 610 provided in a planar shape, and a patch portion 620.

In one configuration, a first feeding line 640 and a second feeding line 650 are formed in the ground portion 610, and a first port 645 and a second port 655 are formed to supply power through the first feeding line 640 and the second feeding line 650, respectively.

In this example, at least a portion of the second feeding line 650 is disposed in parallel with the first feeding line 640, and a remaining portion of the second feeding line 650 is disposed in a vertical direction relative to the first feeding line 640.

In this configuration, the patch portion 620 is separated from the ground portion 610 to cover at least a portion of the ground portion 610. A radiation portion 630 is formed to be recessed at a predetermined depth along a boundary of the patch portion 620.

The radiation portion 630 may radiate, to an external area, energy generated using power supplied by the first port 645, the second port 655, the first feeding line 640, and the second feeding line 650. The radiation portion 630 is formed to be recessed at the predetermined depth along the boundary of the patch portion 620, and perform a function identical to a function of the slot 130 of FIG. 1.

A first input impedance of the antenna viewed from the first port 645 may differ from a second input impedance of the antenna viewed from the second port 655.

Similar to the two-port cavity-backed slot antenna, the two-port patch antenna adjusts an input impedance viewed from each port and a resonant frequency of the antenna. Descriptions about a method of adjusting the input impedance viewed from each port and the resonant frequency of the antenna will be provided with reference to FIG. 7.

Figure 7:
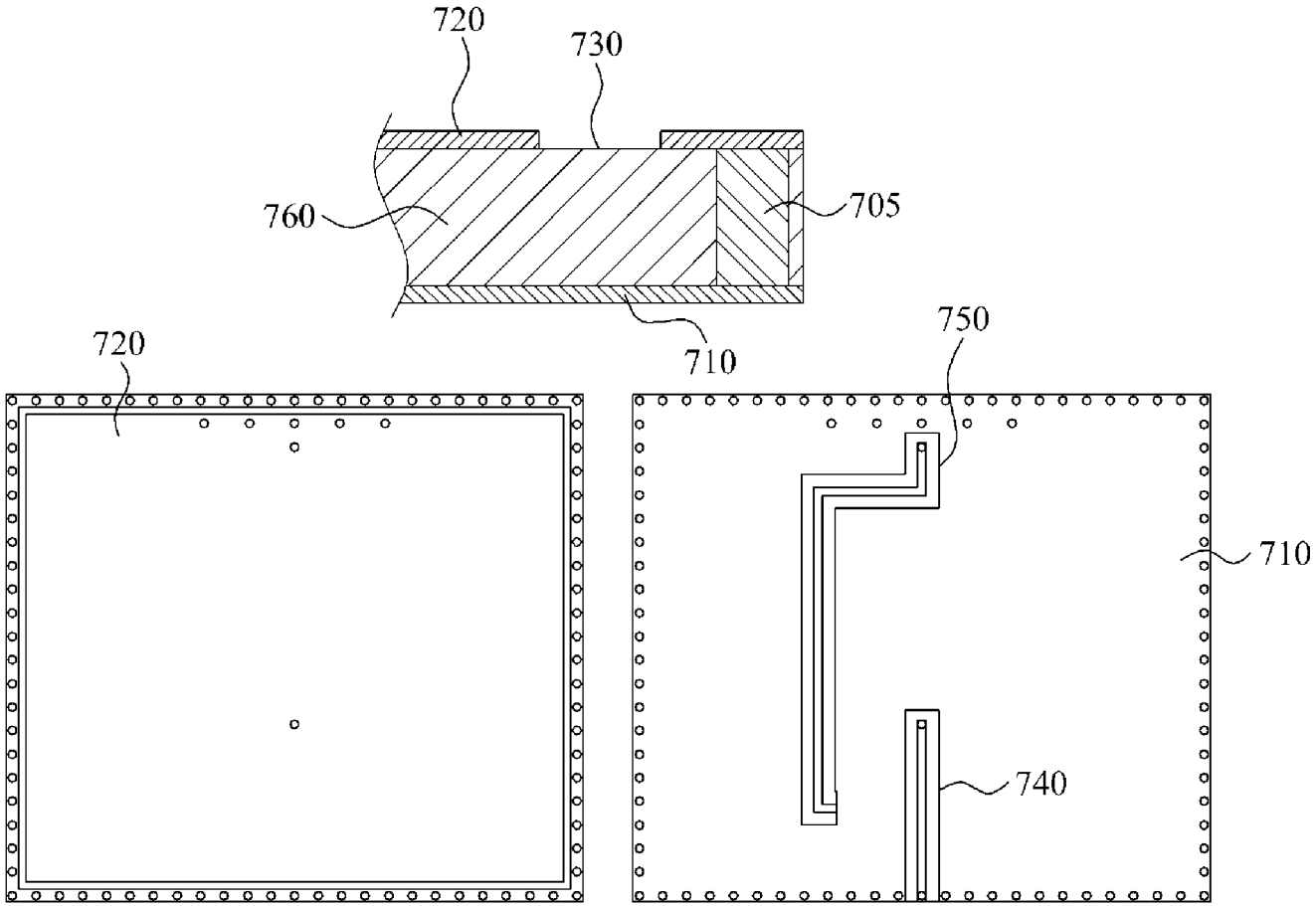
FIG. 7 illustrates a cross-sectional view and an exploded view of an example of the antenna of FIG. 6.

FIG. 7 illustrates a cross-sectional view and an exploded view of an example of the antenna of FIG. 6.

Referring to FIG. 7, a cross-sectional view of a patch antenna is shown in an upper portion, a top surface of the patch antenna is shown in a lower left portion, and a bottom surface of the patch antenna is shown in a lower right portion.

In one example, in the patch antenna, a portion between a ground portion 710 and a patch portion 720 is filled with a dielectric layer 760, and the ground portion 710 is connected to the patch portion 720 using a via 705, for example, a via hole.

A radiation portion 730 is formed at a predetermined depth along a boundary of the upper side of the patch portion 720. Similarly, the via 705 is formed on the boundary of the patch portion 720, externally to the radiation portion 730.

A first feeding line 740 and a second feeding line 750 is formed on a lower side of the ground portion 710 of the patch antenna. A perimeter of each of the first feeding line 740 and the second feeding line 750 is recessed in a direction similar to a direction in which the radiation portion 730 is recessed.

The first input impedance of the antenna viewed from the first port, for example, the first port 645 of FIG. 6, disposed internally relative to the first feeding line 740, may differ from the second input impedance of the antenna viewed from the second port, for example, the second port 655 of FIG. 6, disposed externally relative to the second feeding line 650.

The first input impedance may be adjusted based on a position of an end portion of the first feeding line 640. The position of the end portion of the first feeding line 740 may be a position of the first port 645 in the ground portion 710.

Also, the second input impedance may be adjusted based on a position of an end portion of the second feeding line 650. Similarly, a position of an end portion of the second feeding line 750 may be a position of the second port 655 in the ground portion 710.

Similar to the two-port cavity-backed slot antenna in which input impedance is attuned by relocating a feeding point, in the patch antenna, input impedance may be attuned by adjusting the position of the end portion of the feeding lines.

Also, a resonant frequency of the antenna may be adjusted based on a depth to which the first feeding line 740 or the second feeding line 750 penetrates from a surface of the ground portion 710 into a center portion.

For example, the greater a distance between the center portion and the first feeding line 740 or the second feeding line 750, the lower the resonant frequency.

Principles of the two-port cavity-backed slot antenna described with reference to FIGS. 1 through 5 may be applied to a method of adjusting the resonant frequency and the input impedance viewed from each port of the patch antenna and; thus, repeated descriptions will be omitted here.

According to an aspect of various embodiments, because a loss does not occur when a transmitter and a receiver are used directly, it is possible to improve overall system efficiency and increase a size of a bandwidth.

According to another aspect of various embodiments, because implementation of a matching circuit having a relatively high impedance conversion ratio is not necessary, a level of complexity is reduced in each of a transmitter and a receiver and a size of a chip to be included in the transmitter and the receiver is also reduced.

While this disclosure includes specific examples, it will be apparent to one of ordinary skill in the art that various changes in form and details may be made in these examples without departing from the spirit and scope of the claims and their equivalents.

Therefore, the scope of the disclosure is defined not by the detailed description, but by the claims and their equivalents, and all variations within the scope of the claims and their equivalents are to be construed as being included in the disclosure.

DESCRIPTION OF THE REFERENCE NUMERALS

110: dielectric substance
120: first feeding line
123: via
143: via
130: slot
140: second feeding line
150: first port
160: second port
170: substrate
180: metallic conductor

What is claimed is:

1. An antenna, comprising:

a rectangular slot forming a cavity in a metallic substrate;

a dielectric substrate configured to cover at least a portion of the slot; and a first port and a second port configured to supply power to the antenna using a first feeding line and a second feeding line, wherein the first and second feeding line are connected to the slot through the dielectric substrate with a first and second via, respectively, wherein a first input impedance of the antenna from the first port varies based on a feeding offset from a center of the slot to a first feeding point, at which the slot is in contact with the first feeding line, and wherein a second input impedance of the antenna from the second port varies based on a feeding offset from the center of the slot to a second feeding point, at which the slot is in contact with the second feeding line, wherein a first end of the slot and a second end of the slot are closed, and wherein:

the first feeding line extends away from the first end of the slot in a first direction, and the second feeding line extends away from the second end of the slot in a second direction opposite the first direction.

2. The antenna of claim 1, further comprising:

a first switch disposed in the first feeding line to switch, to the slot, power supplied through the first feeding line, wherein a resonant frequency of the antenna is adjusted based on a position of the first switch in the first feeding line.

3. The antenna of claim 1, further comprising:

a second switch disposed in the second feeding line to switch, to the slot, power supplied through the second feeding line, wherein a resonant frequency of the antenna is adjusted based on a position of the second switch in the second feeding line.

4. The antenna of claim 1, wherein the first port is separate from the second port, and the first port and the second port, each is connected to the slot in a vertical direction.

5. An antenna, comprising:

a first feeding line connected to one end of a slot through a first via in a dielectric substrate at one end of the first feeding line and connected to a first port at another end of the first feeding line;

a second feeding line connected to an opposite end of the slot through a second via in the dielectric substrate at one end of the second feeding line and connected to a second port at another end of the second feeding line;

wherein the slot forms a rectangular cavity in a metallic substrate, and the dielectric substrate is configured to cover at least a portion of the slot;

a first switch disposed in the first feeding line; and a second switch disposed in the second feeding line, wherein a first input impedance at the first port and a second input impedance at the second port are attuned by adjusting a feeding position of the first switch and the second switch, wherein the first input impedance varies by adjusting the feeding position from a center of the slot to a first feeding point, at which the slot is in contact with the first feeding line, wherein the second input impedance varies by adjusting the feeding position from the center of the slot to a second feeding point, at which the slot is in contact with the second feeding line, and wherein:

the first feeding line extends away from the one end of the slot in a first direction, and the second feeding line extends away from the opposite end of the slot in a second direction opposite the first direction.

6. The antenna of claim 5, wherein a resonant frequency of the antenna is adjusted based on a position of the first switch in the first feeding line.

7. The antenna of claim 5, wherein a resonant frequency of the antenna is adjusted based on a position of the second switch in the second feeding line.

8. The antenna of claim 5, wherein when a distance between the slot and the first switch in the first feeding line increases, the resonant frequency of the antenna in the second port decreases.

9. The antenna of claim 5, wherein when a distance between the slot and the second switch in the second feeding line increases, the resonant frequency of the antenna in the first port decreases.

10. The antenna of claim 5, wherein a feeding offset is a distance from a center point of the slot to each of the first feeding point and the second feeding point, at which the slot is in contact with each of the feeding line and the feeding line.

11. The antenna of claim 5, wherein each of the first port and the second port is connected to the slot in a vertical direction.

* * * * *